US006371116B1

(12) United States Patent
Resnick

(10) Patent No.: US 6,371,116 B1
(45) Date of Patent: Apr. 16, 2002

(54) METHOD AND APPARATUS FOR PRESSURIZING A PROTECTIVE HOOD ENCLOSURE WITH EXHALED AIR

(76) Inventor: Todd A. Resnick, P.O. Box 1559, Stuart, FL (US) 34995-1559

( * ) Notice: Subject to any disclaimer, the term of this patent is extended or adjusted under 35 U.S.C. 154(b) by 0 days.

(21) Appl. No.: 09/654,582

(22) Filed: Sep. 1, 2000

Related U.S. Application Data

(63) Continuation-in-part of application No. 09/339,762, filed on Jun. 24, 1999, now abandoned.

(51) Int. Cl.[7] ..... A62B 18/02

(52) U.S. Cl. ..... 128/206.24; 128/201.22; 128/201.23; 128/201.29; 128/205.27; 128/205.29; 128/206.12; 128/206.16; 128/206.21; 128/206.23; 128/206.28; 2/202; 2/413; 2/DIG. 1; 2/DIG. 3; 2/DIG. 10

(58) Field of Search ..... 128/201.22, 201.23, 128/201.29, 205.27–205.29, 206.12, 206.16, 206.17, 206.21, 206.23, 206.24, 206.28; 55/DIG. 33, DIG. 35; 2/202, 203, 448, 413, DIG. 1, DIG. 3, DIG. 10

(56) References Cited

U.S. PATENT DOCUMENTS

| | | | | |
|---|---|---|---|---|
| 577,956 A | | 3/1897 | Henderson | |
| 2,331,283 A | * | 10/1943 | Wheeler | 2/202 |
| 2,861,568 A | | 11/1958 | Quilter et al. | |
| 3,167,070 A | | 1/1965 | Silverman | |
| 3,343,535 A | | 9/1967 | Lytle et al. | |
| 3,680,555 A | | 8/1972 | Warncke | |
| 3,935,861 A | | 2/1976 | Warncke | |
| 4,404,969 A | | 9/1983 | Cresswell et al. | |
| 4,484,575 A | | 11/1984 | Brockway et al. | |
| 4,619,254 A | | 10/1986 | Moretti et al. | |
| H805 H | | 8/1990 | Schriver et al. | |
| 5,549,104 A | | 8/1996 | Crump et al. | |
| 5,558,089 A | | 9/1996 | Castiglione | |
| 5,575,278 A | | 11/1996 | Bonhomme et al. | |
| 5,653,225 A | | 8/1997 | Schegerin | |
| 6,014,971 A | * | 1/2000 | Danisch et al. | 128/201.25 |
| 6,102,034 A | * | 8/2000 | Buhlmann | 128/201.29 |
| 6,176,239 B1 | * | 1/2001 | Grove et al. | 128/206.24 |

FOREIGN PATENT DOCUMENTS

| | | |
|---|---|---|
| DE | 302545 | 1/1916 |
| DE | 597685 | 5/1934 |
| DE | 3925498 A | 1/1991 |
| GB | 2141348 A | 12/1984 |
| GB | 2240463 A | 8/1991 |
| WO | PCT/GB90/01324 | 3/1991 |

OTHER PUBLICATIONS

AOSafety Products, Respiratory Protection, Escape Artist Respirator, http://aearo.com/html/products/respirat/escape.htm, Jun. 8, 1999.

* cited by examiner

*Primary Examiner*—John G. Weiss
*Assistant Examiner*—Joseph F. Weiss, Jr.
(74) *Attorney, Agent, or Firm*—Anton J. Hopen; Smith & Hopen, P.A.

(57) ABSTRACT

An air-impermeable hood having first and second substantially airtight seals adapted to encircle a portion of a wearer's body below the head, typically the neck. Continuously exhaled air from the wearer of the hood is channeled between the first and second seals pressurizing a space there between creating a continuously pressurized purge zone to the introduction of ambient air into the hood. When the pressure in the purge zone exceeds the resistance of the second seal, air taking the path of least resistance flows out of the second seal. The effect is that exhaled air from the wearer creates a pressurized barrier against ambient air yet also prevents the accumulation of excess carbon dioxide and moisture within the ocular area.

18 Claims, 9 Drawing Sheets

METHOD AND APPARATUS FOR PRESSURIZING A PROTECTIVE HOOD ENCLOSURE WITH EXHALED AIR

CROSS REFERENCE TO RELATED APPLICATION

This application claims the benefit and is a Continuation-in-Part of U.S. Pat. application Ser. No. 09/339,762 filed Jun. 24, 1999, now abandoned. The disclosure of the previous application is incorporated herein in its entirety by reference.

FIELD OF INVENTION

The present invention relates generally to respiratory protective devices and more particularly, to an exhaled air pressured hood enclosure.

BACKGROUND OF THE INVENTION

Respiratory protective hoods benefit from positive air pressure within the hood to keep out contaminated, ambient air. This plenum provides a substantial level of protection should the protective enclosure be temporarily compromised. A significant danger exists when wearers of respiratory hoods breathe in air within the hood that may introduce harmful contaminants into the hood. One solution to this problem is to utilize exhaled air to keep the hood inflated and pressurized thereby creating a plenum against the introduction of ambient air. However, with each breath of exhaled air, the wearer introduces additional carbon dioxide and humidity into the hood.

The air that enters the lungs contains approximately 21 percent oxygen and 0.04 percent carbon dioxide. By contrast, the air that leaves the lungs contains 14 percent oxygen and 4.40 percent carbon dioxide. Consequently, a high level of carbon dioxide may accumulate within the hood.

Humidity is a measure of the amount of water vapor in the air. The air's capacity to hold vapor is limited but increases dramatically as the air warms, roughly doubling for each temperature increase of 10° C. (18° F.). As the body is exhaling warm, moist air, the humidity within the hood becomes increasingly high. In combination with a high concentration of carbon dioxide, this results in the hood becoming uncomfortably hot. In addition, outward vision while wearing a protective hood is typically achieved through the use of a transparent material integrated into the hood in front of the eyes. By accumulating carbon dioxide and humidity within the hood, moisture accumulates on the transparent material thereby inhibiting outward vision.

Another drawback in the prior art is that even if the user properly exhales into the hood to create the plenum, air pressure may reduce over time that requires the user to continually monitor the plenum in the hood to be assured that sufficient positive air pressure exists.

Standard gas masks must be manufactured in many different sizes because the structure of the nose and mouth area varies widely in populations including children and adults. It is logistically impractical for an authority responding to an emergency involving a large population to transport and fit a conventional face sealing gas mask to the victims. Face sealing gas masks must accommodate the variations of individual faces which would require the responding authority to not only stock and transport an inordinate number of masks, but it would also requires the authority to take a significant amount of time to assign the correct mask to the individual. Further compounding this problem is the fact that conventional face sealing gas masks must be adjusted to the fit the wearer. Again, this consumes a significant amount of time that may not be available, particularly when a large number of victims need assistance at the same time. What is needed is a protective device that can be quickly donned, yet accommodate the varying physiological differences within a given population.

Hooded masks are generally secured around the circumference of the neck and benefit from enhanced protection of the head area. However, this circumference can vary widely in a population. Furthermore, belts, elastic bands and the like are often used to tighten the seal between the hood and the neck. This tightening is difficult and time-consuming to achieve in an emergency situation and the user may either make the seal too loose and not provide adequate protection or may make the seal too tight leading to an uncomfortable fit that presses against the arteries and veins in the neck.

Another problem in the prior art involves the speed of donning the protective hood and establishing a secure respiratory pathway. Some hood embodiments in the prior art require the user to exhale into the hood before engaging the air filtration system. This added step not only adds to the time in which the hood becomes effective, but also increases the level of training needed to operate the hood properly. In many applications, protective hoods are designed for use in high-stress, dangerous environments. Reducing the speed in which the hood becomes effective and reducing the training required for operating the hood is beneficial. Furthermore, protective hoods may be distributed to an untrained civilian population that may have little or no training in donning and operating the protective hoods correctly. Therefore, simplification of operation and speed of use again become advantageous.

An object of this invention is to provide an air purifying respirator hood that automatically creates a plenum around the head.

Another object of this invention is to reduce the amount of moisture and carbon dioxide within the ocular region of a hood inflated by the wearer's exhalation.

Another object of this invention is to increase the overall protection factor of an air purifying respirator hood by establishing one or more pressurized zones against the introduction of ambient air into the hood enclosure.

Another object of this invention is to provide a continuously pressurized hood without the need for an external air source.

Another object of this invention is to provide a protective respirator hood having a substantially universal fit.

Previous attempts have been made to provide a protective hood enclosure such as described in U.S. Pat. No. 5,495,847 to Hu ('847 patent); U.S. Pat. No. 5,411,017 to Wong ('017 patent); U.S. Pat. No. 4,870,959 to Reisman et al. ('959 patent); U.S. Pat. No. 5,186,165 to Swann ('165 patent); U.S. Pat. Nos. 3,935,861 and 3,680,555 to Warncke ('861 and '555 patents); all of which are incorporate herein by reference.

The '017 patent to Wong describes a protective enclosure having elastic collars on the top and bottom. The bottom collar is closed against the wearer's neck and the top collar is closed against the wearer's head. Once donned, ambient air trapped within the protective enclosure is breathed in providing three to five minutes of escape time. However, exhaled air is trapped within the protective enclosure thereby accumulating moisture and carbon dioxide within the enclosure.

The '847 patent to Hu describes a survival hood comprising a hood for the head and neck which has an inside pocket with at least one upward open space, and a gas generator put in the pocket inside the hood to release oxygen through a chemical reaction for breathing when it is bent inwards to break an inside chemical solution container. However, the hood does not provide a secure seal to the neck for protection against NBC agents.

The '959 patent to Reisman et al. describes a protective breathing mask comprising a fire-resistant stretchable material shaped as a hood for wearing over and enclosing the head. The hood is primarily designed to combat smoke inhalation and subsequently does not provide suitable filtration or barrier means to NBC agents. Furthermore, exhaled air is trapped within the protective enclosure thereby accumulating moisture and carbon dioxide within the enclosure.

The '165 patent to Swann describes a deployable hood and mouthpiece having an exhalation check valve to permit exhaled air to flow into the hood. However, the operation of the '165 patent continually introduces carbon dioxide and moisture into the hood enclosure, thereby fogging up outward visibility and causing the wearer discomfort.

The '555 patent to Warncke teaches that intermittent exhaled air is used to pressurize a purge zone around the protection zone and is vented to ambient as needed to avoid over-pressurization of said purge zone. No suggestion of any kind is made that such intermittent exhaled air should be admitted into said protection zone. Furthermore, the '555 patent provides no reservoir of stored pressure during periods of non-exhalation. Accordingly the purge zone in the '555 patent suffers from a substantial fluctuation in pressure during normal respiration.

The '861 patent to Warncke teaches that continuously flowing compressed gas from a remote source of compressed gas should flow into a protection zone. No suggestion of any kind is made that said continuous flow of compressed gas should be supplanted by intermittent exhaled air. Similar to the '555 patent, the '861 fails to describe a reservoir for pressuring a purge zone absent the remote source of compressed gas.

Consequently, there is a need in the art for an air purifying respirator hood that automatically creates a plenum around the head.

There is a further need in the art to reduce the amount of moisture and carbon dioxide within a hood inflated by the wearer's exhalation.

There is a further need in the art to increase the overall protection factor of an air purifying respirator hood by providing at least one pressurized zone against the introduction of ambient air into the hood enclosure.

There is a further need in the art to provide a continuously pressurized protective hood without the need for an external air source.

However, in view of the prior art at the time the present invention was made, it was not obvious to those of ordinary skill in the pertinent art how the identified needs could be fulfilled.

SUMMARY OF THE INVENTION

The above and other objects of the invention are achieved in the embodiments described herein by providing a multiple zone protective enclosure comprising an air-impermeable hood adapted to receive a wearer's head. The air-impermeable hood has a closed first end and an open second end and an air-impermeable transparent viewing area integrated into the air-impermeable hood, the air-impermeable transparent viewing area adapted to permit outward vision by the wearer. A first substantially airtight seal is provided having a predetermined resistance to airflow, having an outer peripheral edge secured to the second end of the air-impermeable hood, and having an inner peripheral edge adapted to sealingly engage a wearer's neck. A second substantially airtight seal is provided having a predetermined resistance to airflow, having an outer peripheral edge secured to the second end of the air-impermeable hood and having an inner peripheral edge adapted to sealingly engage a wearer's neck. The inner peripheral edge of the first substantially airtight seal is adapted to sealingly engage said wearer's neck along a first annular line of contact and the inner peripheral edge of the second substantially airtight seal is adapted to sealingly engage the wearer's neck along a second annular line of contact.

The first and second annular lines of contact are disposed in vertically spaced apart relation to one another when the hood encloses the head of the wearer. The air-impermeable hood and the first substantially airtight seal define a protection zone adapted to enclose the head of the wearer. The protection zone is adapted to surround the head of the wearer. A purge zone is defined between the first and second substantially airtight seals and adapted to encircle the neck of the wearer. A respiration interface having an inhalation pathway and an exhalation pathway is provided. The inhalation pathway is adapted to receive purified air and the exhalation pathway adapted to dispatch exhaled air. An exhalation conduit is disposed in fluid communicating relation between the exhalation pathway and the purge zone.

The first and second substantially airtight seals may be constructed in several fashions. In order to conserve production costs, die-cutting may be employed to fabricate the seals. However, in a preferred embodiment, a higher protection factor may be achieved by molding the first substantially airtight seal with a downwardly disposed lip on the inner peripheral edge coming into contact with the wearer's neck. The downwardly disposed lip increases the surface area of the first substantially airtight seal with the wearer's neck and also resists the passage of exhaled air into the protection zone.

The exhalation conduit having a one-way check valve means is adapted to restrict the flow of exhaled air only from the exhalation pathway to one or more purge zones. Therefore exhaled air is not directly introduced into the protection zone but is channeled through the exhalation conduit into one or more purge zones.

In the operation of the invention, air exhaled into the exhalation conduit flows into at least one purge zone increasing the air pressure within the purge zone until air, following the path of least resistance, is forced downward and out of the enclosure. During this operation, it is not necessary that the protection zone be pressurized as the purge zone maintains an effective barrier to ambient air outside the hood. This establishes a pressurized zone around the second seal using exhaled air while preventing the exhaled air from accumulating in the protection zone thereby preventing the transparent viewing area from fogging.

In a preferred embodiment of the invention, the exhalation conduit is mated internally within the air-impermeable hood. Alternatively, the exhalation conduit may be mated externally to the air-impermeable hood to discharge exhaled air into one or more purge zones. However, externally mating the exhalation conduit may increase the expense of manufacture and require additional external fittings to the hood that may be exposed to hazardous substances.

Another benefit of internally mating the exhalation conduit is that the first and second substantially airtight seals forming the purge zone into which the exhaled air enters may closely overlay each other. This is achieved by integrating the end of the exhalation conduit from which exhaled air is discharged into the first substantially airtight seal. When the invention is unpressurized, the first and second substantially airtight seals may be in direct contact. However, when exhaled air is discharged between the first and second substantially airtight seals, they are separated by the exhaled air thereby forming the purge zone. Should the conduit be externally mated to the air-impermeable hood, the end of the exhalation conduit from which exhaled air is discharged must be integrated into the side of the air-impermeable hood. This requires the first and second substantially airtight seals to be separated even when in an unpressurized state.

However, in a preferred embodiment, an air-impermeable seal column depends from the second end of the air-impermeable hood. The air-impermeable seal column has a first end and a second end. The first substantially airtight seal is engaged to the second end of the hood and the second substantially airtight seal is engaged to the second end of the seal column thereby vertically spacing the first substantially airtight seal apart from the second substantially airtight seal. This provides a greater comfort level to the wearer, particularly in the neck region as veins and tight-fitting seals that are unevenly distributed may pinch arteries. Another advantage of vertically separating the seals is that the resultant purge zone supports a greater volume of pressurized exhaled air thereby increasing the protection factor of the invention.

A modular purge zone may be prefabricated for integration into the air impermeable hood. The first substantially airtight seal is pre-sealed to the first end of the seal column and the second substantially airtight seal is pre-sealed to the second end of the seal column. Accordingly, a modular purge zone is thereby formed for integration into the air-impermeable hood. Additional modular purge zones may be stacked vertically to provide multiple purge zones.

By varying the relative resistance to airflow between the first and second seals, airflow can be controlled to achieve a desired effect. The variance of airflow resistance may be generally described in three alternative embodiments. In a first embodiment, the first substantially airtight seal has a greater predetermined resistance to airflow than the second substantially airtight seal thereby inhibiting the protection zone from inflating. This embodiment might be preferable in situations where absolutely no fogging of the ocular region is desired for such tasks as sighting a weapon.

In a second embodiment, the first substantially airtight seal has a substantially equal predetermined resistance to airflow than the second substantially airtight seal thereby inhibiting the protection zone from fully inflating.

In a third embodiment, the first substantially airtight seal has a lesser-predetermined resistance to airflow than the second substantially airtight seal thereby fully inflating the protection zone. While the second and third embodiments do introduce a limited amount of carbon dioxide and moisture into the protection zone, they also serve the purpose of heightening the protection factor of the hood by fully or partially pressurizing the protection zone against the introduction of ambient air. Another advantage of pressurizing the protection zone is that the hood expands away from the head of the wearer thereby providing more internal headroom. This is a significant improvement to many existing hoods that are tight fitting and therefore unacceptable to wearers subject to claustrophobia. In one embodiment of the invention, the second substantially airtight seal distal to the first substantially airtight seal encircles the neck of the wearer. In an alternative embodiment, particularly for use in protecting infants and children, the second substantially airtight seal distal to the first substantially airtight seal encircles the torso of the wearer. It is preferable that the seals be constructed of elastomeric material that is resistant to chemical and biological agents such as neoprene, butyl rubber or the like.

It is preferred that elastomeric material having a substantially low elasticity modulus is used to construct the purge zone. Exhaled air flowing into the purge zone causes the purge zone to balloon in volume. This novel feature provides a storage repository for capturing the kinetic energy of the wearer's exhalation. The ballooning of the purge zone is a combination of increased pressure and increased volume, which is effectively stored as energy potential. The elasticity of the purge zone during periods of non-exhalation (typically during inhalation) contracts the total volume, slowly "deflating" the balloon. This controlled deflation serves to direct airflow away from the protection zone in a continuous fashion. As exhalations are intermittent, the ballooning effect of this novel invention insures a continuous reservoir of stored pressure. Furthermore, the increase in volume of the purge zone helps equalize variations in the total pressure between wearer inhalation and exhalation. Accordingly, a substantially constant purge zone pressure may be achieved without the introduction of a remote compressed gas source.

As the first and second substantially airtight seals define the purge zone, use of the elastomeric materials having a substantially low elasticity modulus serves another advantage of providing a substantially universal fit. The inner peripheral edge, when formed of elastomeric material, can accommodate a wide range of neck diameters comfortably. This is particularly useful for protecting civilian populations as well as reducing the costs of maintaining a large number of differing sizes in an inventory. Furthermore, because the inner peripheral edge provides the seal, the protective enclosure may be quickly donned without the need of mechanical adjustments.

Still another advantage of using elastomeric material with a substantially low elasticity modulus is that of compacting the enclosure for storage and transport. As opposed to comparatively rigid, face-sealing masks, the air-impermeable hood, transparent viewing area, and airtight seals may all be constructed of substantially flexible air-impermeable material foldable around the respiration interface which is typically a rigid mechanical structure. Face-sealing masks cannot effectively achieve this level of foldability without sacrificing some structural integrity necessary to seal against the face.

Neoprene and butyl rubber are particularly suitable materials for construction of the purge zone. Neoprene is a polymer of the monomer choloroprene, chemical formula $CH_2{:}C(Cl)CH{:}CH_2$. Neoprene has high resistance to heat and chemicals. Butyl rubber may also be utilized which is prepared by copolymerization of isobutylene with butadiene or isoprene. Butyl rubber is plastic and can be compounded like natural rubber. However, it is difficult to vulcanize. While butyl rubber is not as resilient as natural rubber and other synthetic varieties, it is extremely resistant to oxidation and the action of corrosive chemicals. However, other elastomeric materials with the above-mentioned properties may be suitable as well.

Accordingly, it is an object of the present invention to provide an air purifying respirator hood that automatically creates a plenum around the head.

It is another object of the present invention to reduce the amount of humidity and carbon dioxide within the ocular zone of a hood inflated by the wearer's exhalation.

It is another object of the present invention to increase the overall protection factor of an air purifying respirator hood by establishing at least one pressurized zone against the introduction of ambient air into the hood enclosure.

It is another object of the present invention to provide a continuously pressurized protective hood without the need for an external air source.

An advantage of the invention is that establishing at least one pressurized zone against the introduction of ambient air into the hood enclosure increases the overall protection factor of the protective hood.

Another advantage of the invention is that exhaled air continually purges the pressurized zones against the introduction of ambient air into the hood enclosure.

Another advantage of the invention is that the hood is continuously pressurized without the need for monitoring the plenum and manually inflating the hood.

Another advantage of the invention is that exhaled air may be used to create a plenum around the head while avoiding the negative effects of carbon dioxide and humidity.

Another advantage of the invention is that the mechanical force required to seal the hood enclosure against the introduction of ambient air is lessened by the pressurized zone that dynamically purge air out of the hood.

Another advantage of the invention is that the protection factor of the protective hood has been greatly increased to permit the use of the hood in applications requiring higher protection against airborne substances than the prior art hoods could provide.

Another advantage of the invention is that the hood is continuously pressurized without the need for an external air source.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
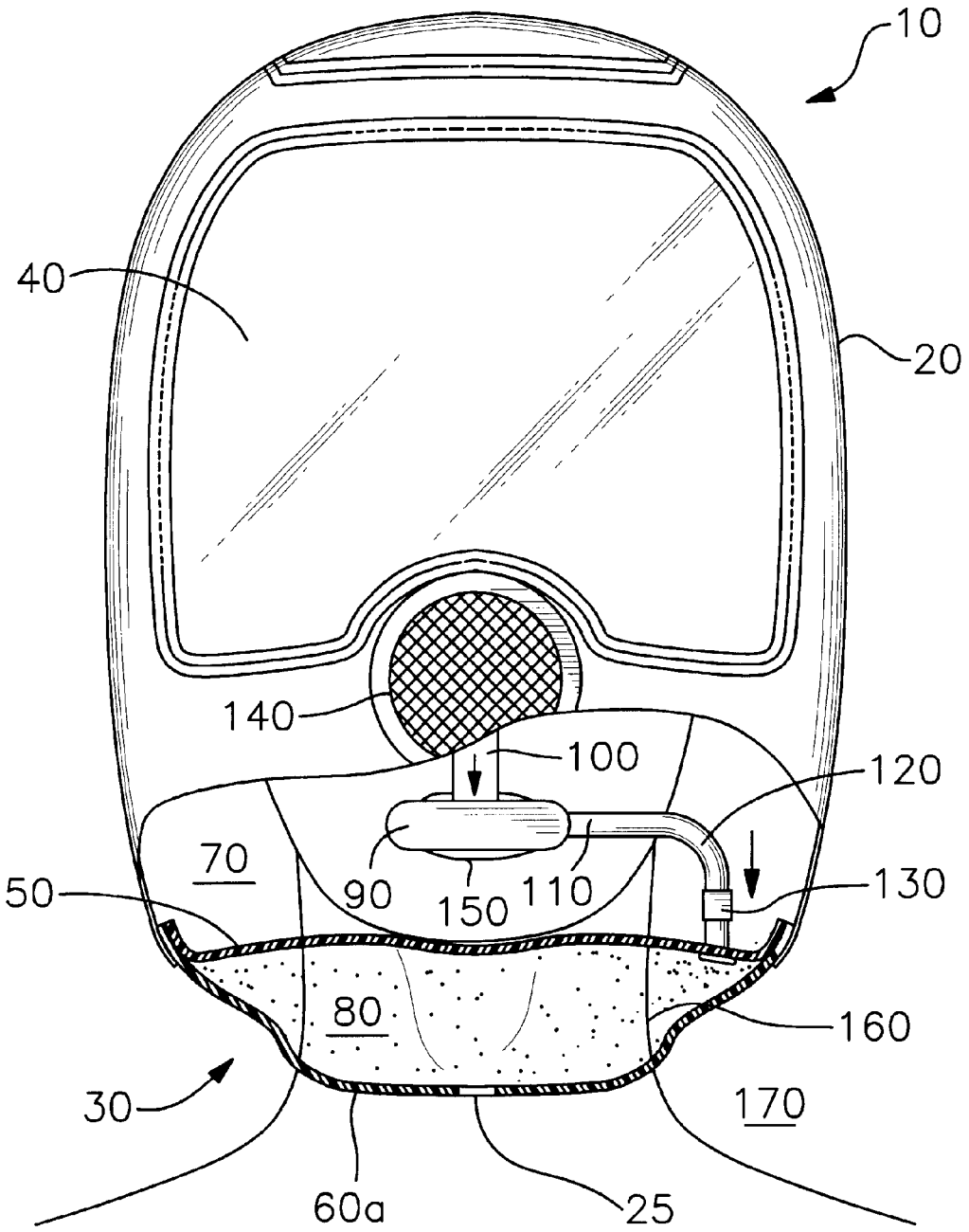
FIG. 1 is a partial sectional, elevational view of the invention utilizing a first substantially airtight seal and a second substantially airtight seal.

Referring initially to FIG. 1, it will there be seen that the reference number 10 as a whole denotes an illustrative embodiment of the present invention. An air-impermeable hood 20 is adapted to enclose the head of a wearer 30 through a hood aperture 25. An air-impermeable transparent viewing area 40 is integrated into the air impermeable hood 20. The transparent viewing area 40 is adapted to permit outward vision by the wearer 30.

A first or first substantially airtight seal 50 is adapted to seal the hood aperture 25 against the wearer's neck 160. A second substantially airtight seal 60*a* is disposed below the first substantially airtight seal 50 forming two substantially airtight zones, a protection zone 70 enclosing the head of the wearer 30 and a purge zone 80 encircling the wearer's neck 160. A respiration interface 90 has an inhalation pathway 100 adapted to receive purified air from an air filtration means 140. An exhalation pathway 110 is adapted to dispatch exhaled air. In the illustrative example, the wearer 30 engages the respiration interface 90 by using a mouthpiece 150. However, it should be noted that other respiration interfaces may be employed other than a mouthpiece with the application of this invention. Such respiration interfaces may include, but are not limited to, half-masks, nose cups, and the like. An exhalation conduit 120 has a one-way check valve means 130 adapted to restrict the flow of exhaled air only from the exhalation pathway 110 into the purge zone 80.

In the operation of the invention, air is continuously exhaled by the wearer 30 through the exhalation pathway 110 and into the exhalation conduit 120 and out into the purge zone 80. The exhalation conduit 120 prevents exhaled air from entering the protection zone 70. The one-way check valve means 130 prevents exhaled air in the purge zone 80 from entering back into the exhalation pathway. The constant exhalation of air thereby flows into the purge zone 80 until air, following the path of least resistance, escapes. The exhaled air may escape in two directions. First, the air may escape through the first substantially airtight seal 50 and into the protection zone 70. Should this happen, exhaled air would inflate the protection zone 70 creating a plenum until such point that the common air pressure in the protection zone 70 and the purge zone 80 overcome the resistance of the second substantially airtight seal 60*a*. Thereafter, additional exhaled air flows out the second substantially airtight seal 60*a* without accumulating additional carbon dioxide and moisture in the protection zone 70.

Alternatively, the exhaled air may only partially inflate the protection zone 70 before overcoming the resistance of the second substantially airtight seal 60*a*. In still another variation, exhaled air may never enter the protection zone, but instead only pressurizes the purge zone 80 before escaping out the second substantially airtight seal 60*a*. It is important to note that regardless of the above-mentioned variations, the air in the purge zone 80 is continually flushed out and replaced with newly exhaled air. This continual purging action provides a heighten level of protection as ambient air 170 that might temporarily penetrate the second substantially airtight seal 60*a* will be purged back out the second substantially airtight seal 60*a* by the continual exhalation process. Consequently, a pressurized barrier is effectuated against ambient air 170 coming into contact with the eyes, nose, mouth, ears and respiratory tract of the wearer 30, all of which are enclosed within the protection zone 70.

Figure 2:
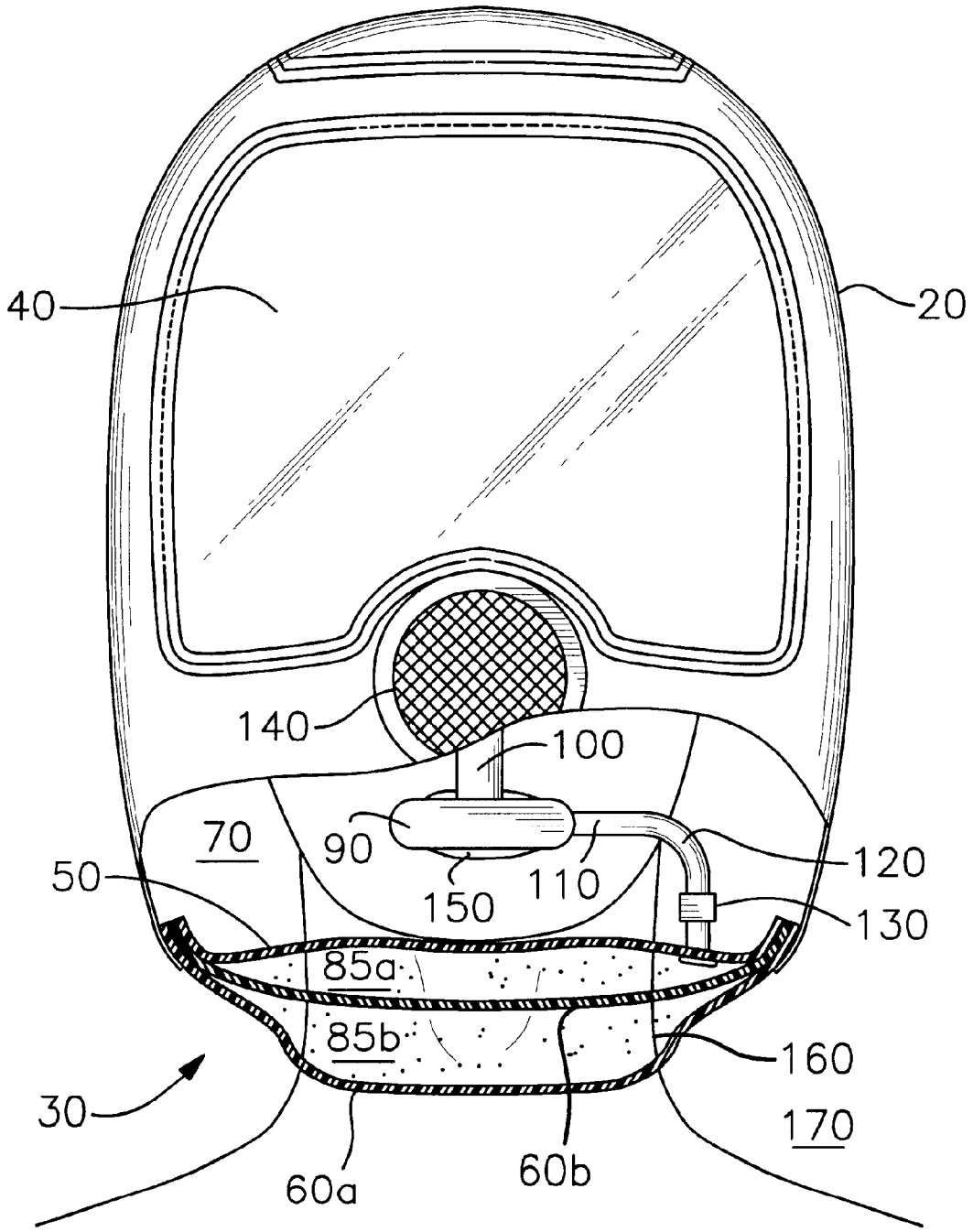
FIG. 2 is a partial sectional, elevational view of the invention utilizing a first substantially airtight seal and two second substantially airtight seals.

A second substantially airtight second seal 60*b* is provided FIG. 2 forming a second purge zone 85*b* disposed below a first purge zone 85*a*. The exhalation conduit 120 penetrates the first substantially airtight seal 50 thereby introducing a continual flow of exhaled air into the first purge zone 85*a*. As the first purge zone 85*a* becomes pressurized, the exhaled air may either escape upward into the protection zone 70 or downward into the second purge zone 85*b*. In a preferred embodiment, the exhalation conduit 120 penetrates the first substantially airtight seal 50 thereby causing the first purge zone 85*a* to pressurize before the second purge zone 85*b* pressurizes. This provides multiple pressurized zones of protection against the introduction of ambient air 170 into the protection zone 70. It should be understood that a plurality of substantially airtight seals might be employed to create an even greater number of purge zones that separate the ambient air 170 from the protection zone 70. The utilization of a plurality of purge zones provides the benefit of redundancy and, consequently, a higher protection factor against hazardous airborne substances.

Figure 3A:
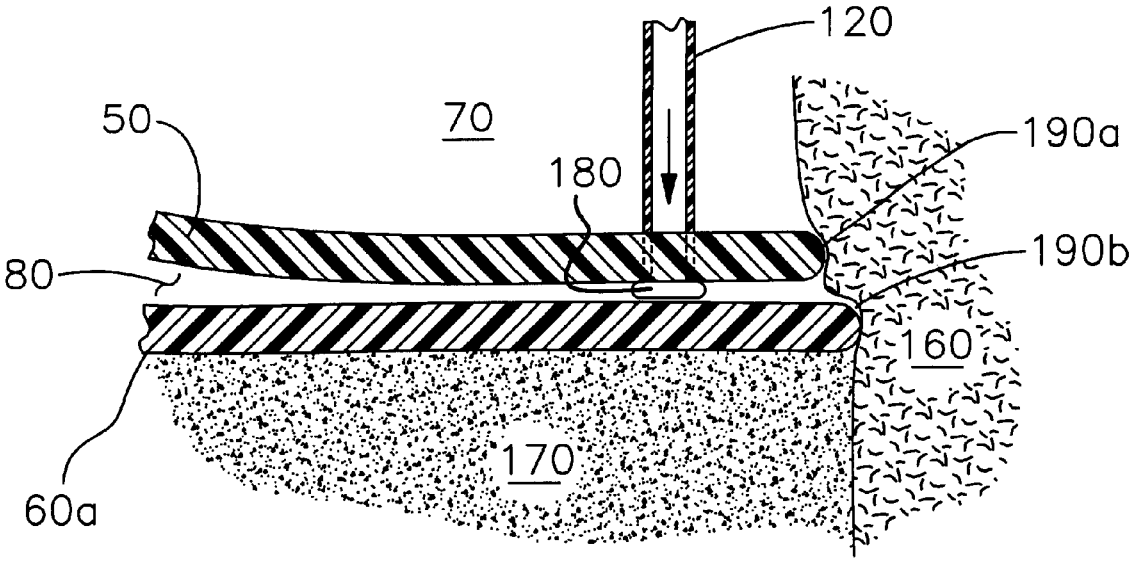
FIG. 3*a* is a sectional view of a first seal and a second seal engaged to a body surface forming a purge zone that is unpressurized.
Figure 3B:
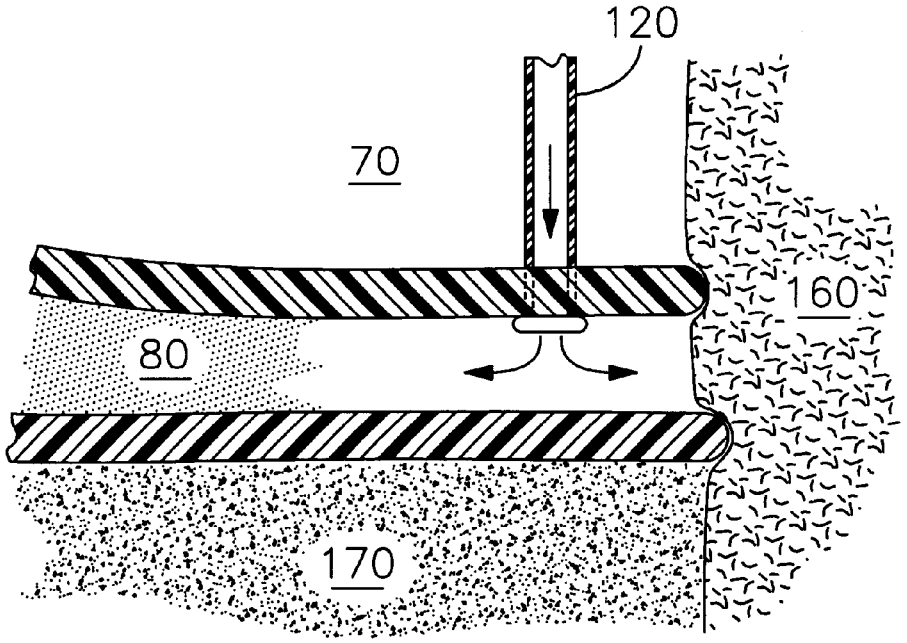
FIG. 3*b* is a sectional view of a first seal and a second seal engaged to a body surface wherein the purge zone is pressurized.

FIGS. 3*a–b* show consecutive stages of operation of the invention. In FIG. 3*a,* the first substantially airtight seal 50 and second substantially airtight seal 60*a* lay juxtaposed to each other. The purge zone 80 is not yet pressurized by exhaled air delivered through the exhalation conduit 120 secured to the first substantially airtight seal by a fastening means 180. The first substantially airtight seal 50 presses against the neck 160 of the wearer 30 creating a first seal indentation 190*a*. The second substantially airtight seal 60*a* also presses against the neck 160 of the wearer 30 creating a second seal indentation 190*b*. The magnitude of the indentations are a result of the force upon which the seals rest against the neck 160. In unpressurized hoods, a seal that presses against the neck with insufficient force provides unsatisfactory protection against ambient air. Alternatively, if the seal presses against the neck with great force to provide high protection, the wearer is subject to discomfort, particularly because of the large number of arteries and veins within the neck.

In FIG. 3*b,* exhaled air discharged from the exhalation conduit 120 pressurizes the purge zone 80 and the first substantially airtight seal 50 and the second substantially airtight seal 60*a* move apart. At this stage, ambient air 170 is increasingly restricted from entering the protection zone 70 as the purge zone 80 is pressurized thereby forming a barrier to the ambient air 170. As exhaled air is continually discharged into the purge zone 80, the air pressure in the purge zone 80 increases until either the first substantially airtight seal 50 or the second substantially airtight seal 60*a* are overcome and the exhaled air passes through. As previously noted, the exhaled air from the purge zone 80 may fully pressurize the protection zone 70, it may partially pressurize the protection zone 70, or may simply exit downwardly out one or more second substantially airtight seals without ever entering the protection zone 70. However, in every permutation of airflow, at least two objectives are achieved: (1) only a limited amount of carbon dioxide and moisture, if any at all, will be introduced into the protection zone and (2) a constant purge of pressurized exhaled air provides a heightened level of protection against the introduction of ambient air into the protection zone.

Figure 3C:
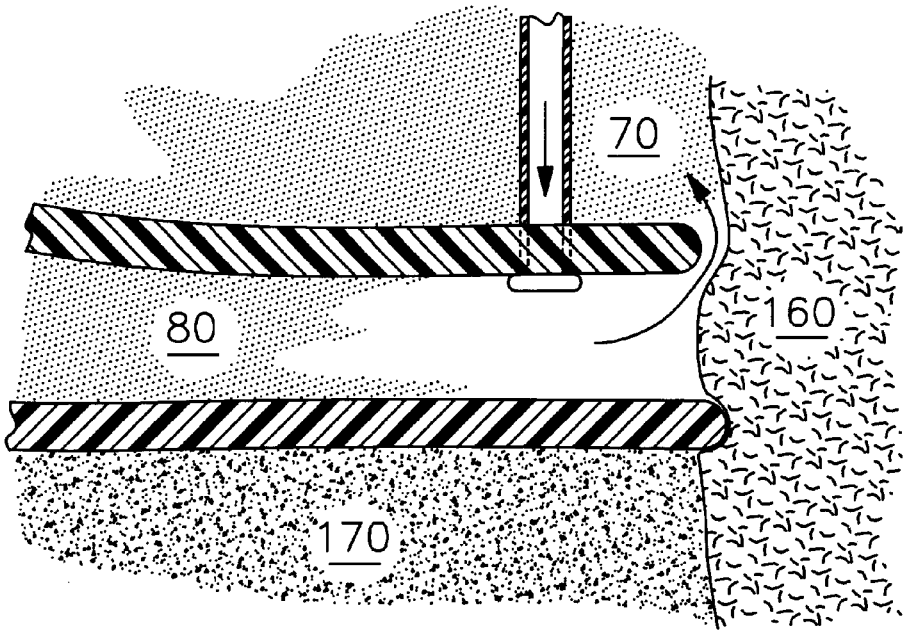
FIG. 3*c* is a sectional view of a first seal and a second seal engaged to a body surface showing air entering the protection zone.
Figure 3D:
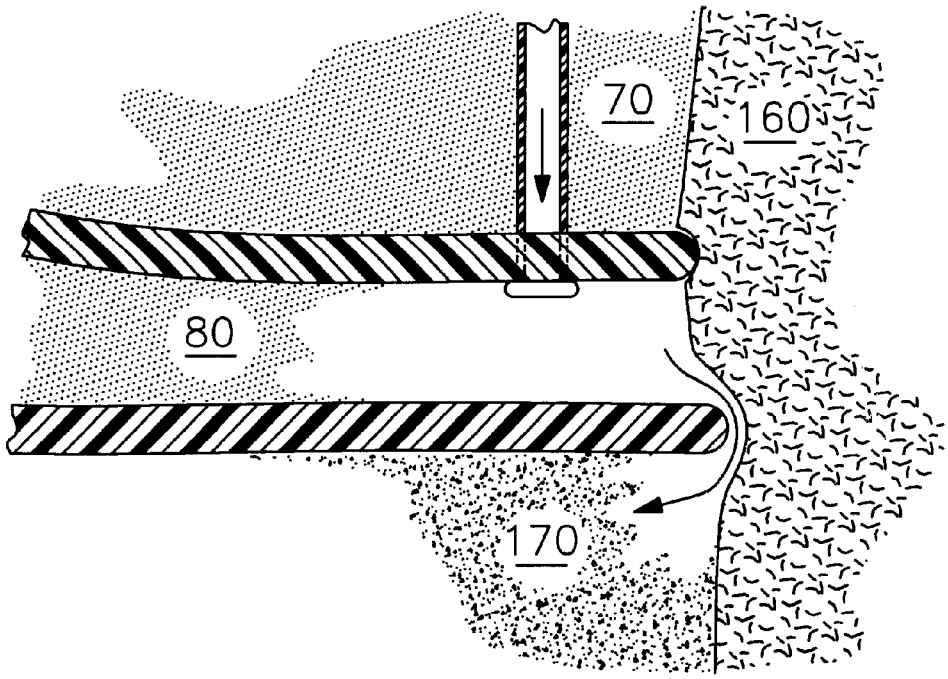
FIG. 3*d* is a sectional view of a first seal and a second seal engaged to a body surface showing the discharge of remaining exhaled air out the second seal.

In FIG. 3*c,* excess pressurized exhaled air in the purge zone 80 overcomes the resistance of the first substantially airtight seal 50 before it overcomes the resistance of the second substantially airtight seal 60*a*. Exhaled air then inflates in the protection zone 70. Although some moisture and carbon dioxide do enter the protection zone 70, the pressure in the protection zone 70 and the purge zone 80 eventually increase until the airflow of the exhaled air changes as in FIG. 3*d* to escape out the second substantially airtight seal. Exhaled air, taking the path of least resistance, will continue to flow out the second substantially airtight seal 60*a* as the protection zone 70 and the purge zone 80 are maintained at a higher pressure than the atmosphere outside the hood 20.

Figure 4:
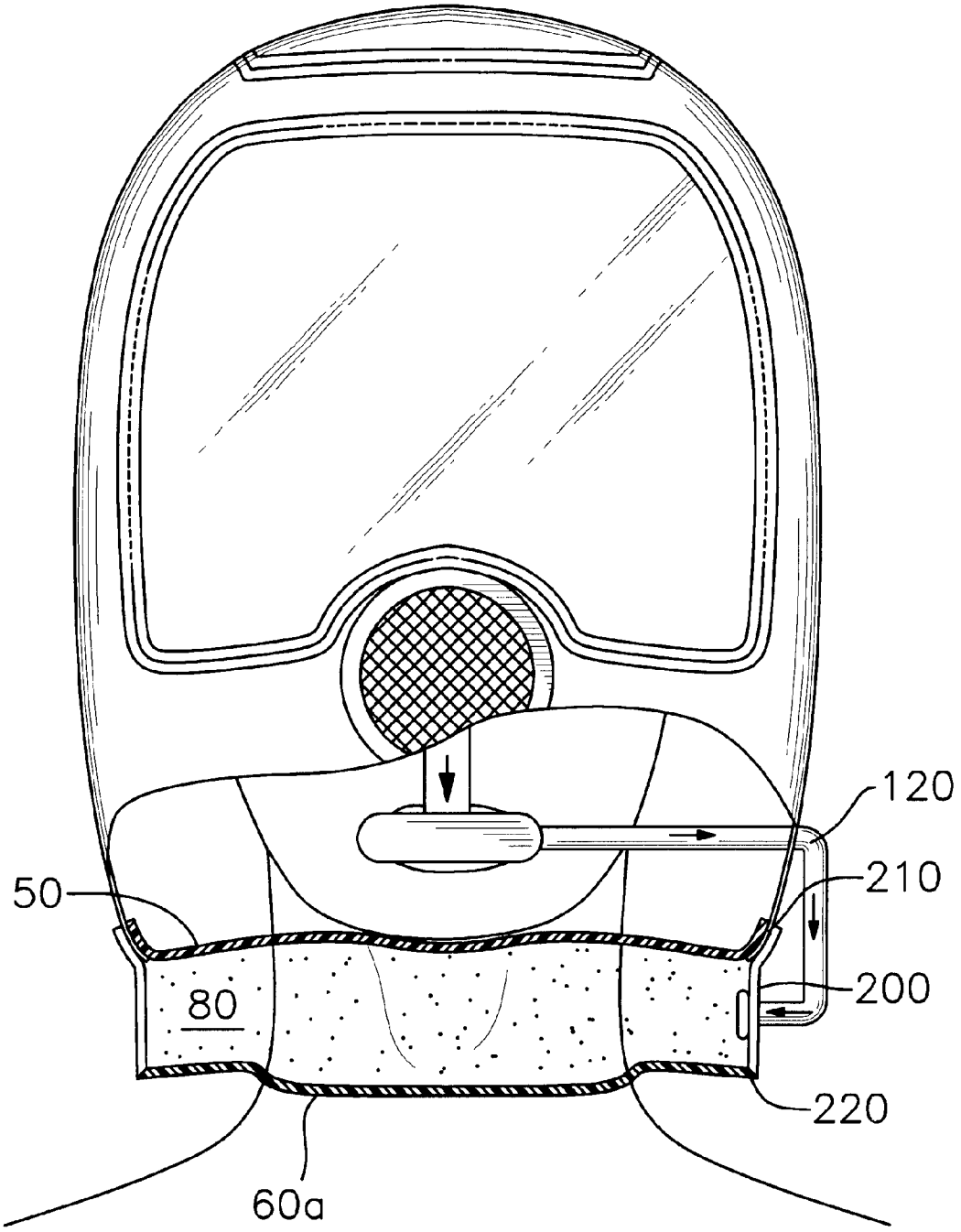
FIG. 4 is a partial sectional, elevational view of an alternative embodiment of the invention having vertically separated first and second substantially airtight seals.

FIG. 4 illustrates an alternative embodiment of the invention wherein the first substantially airtight seal 50 and the second substantially airtight seal 60*a* are vertically separated by a seal column 200. The first substantially airtight seal 50 is engaged to an inner perimeter of the hood aperture 25 and the second substantially airtight seal 60*a* is engaged to a second inside perimeter 220 of the seal column. By vertically separating the first substantially airtight seal 50 and the second substantially airtight seal 60*a* the compressive loads of the seals against the body are distributed across a greater surface area. This provides a greater comfort level to the wearer, particularly in the neck region as veins and tight-fitting seals that are unevenly distributed may pinch arteries. Another advantage of vertically separating the seals is that the resultant purge zone 80 supports a greater volume of pressurized exhaled air thereby increasing the protection factor of the invention. Also shown in FIG. 4 is an externally located exhalation conduit 120.

Figure 5:
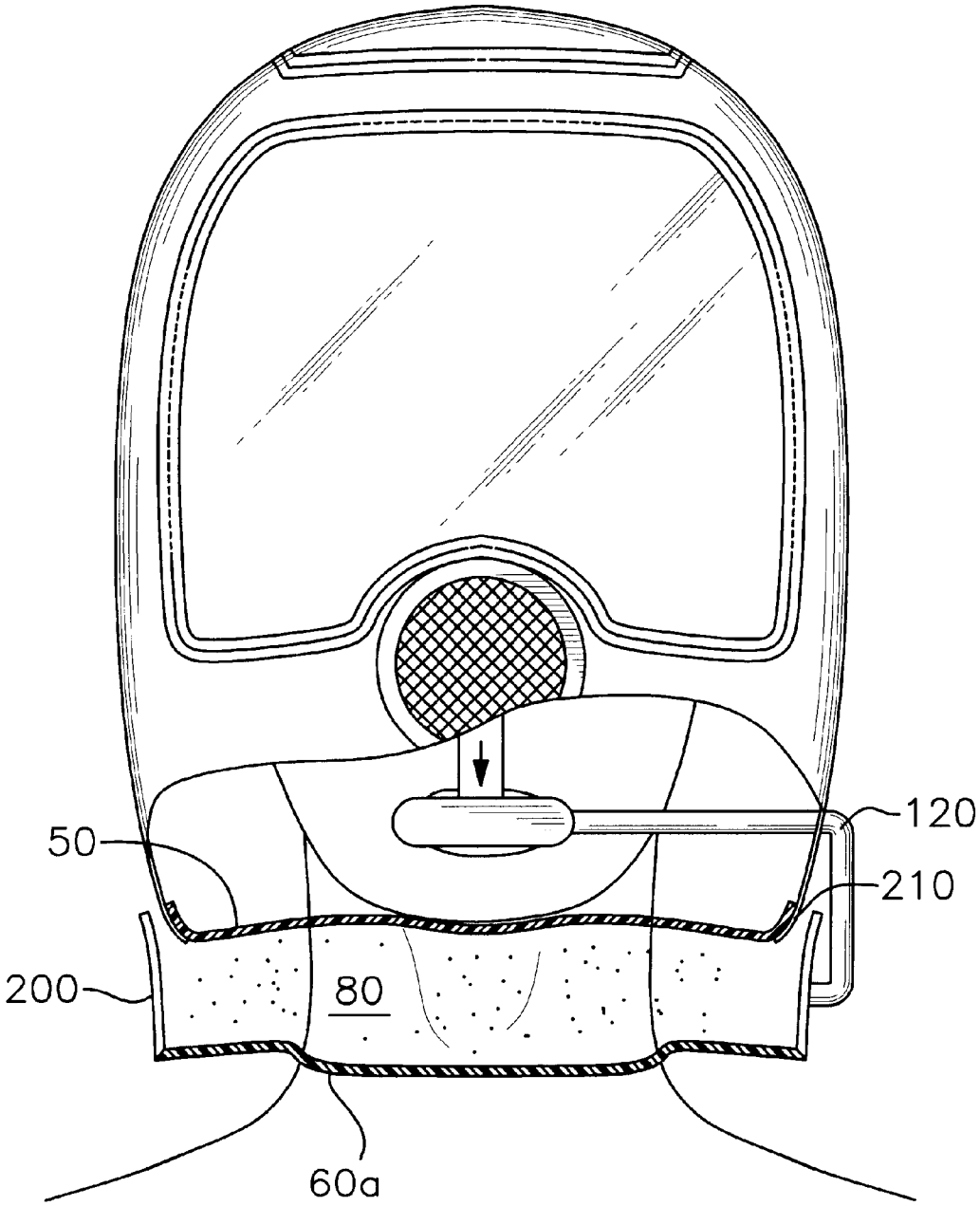
FIG. 5 is a partial sectional, partially exploded, elevational view of an alternative embodiment of the invention having vertically separated first and second substantially airtight seals.

FIG. 5 shows a partially exploded view of an alternative embodiment of the invention utilizing the seal column. FIG. 5 illustrates an attachment point of the seal column at the outside second perimeter 210 of the protective enclosure of the hood. The second substantially airtight seal is engaged to the second inside perimeter of the seal column 200 while the first substantially airtight seal 50 is attached to the hood itself at the inner perimeter of the hood aperture. When the seal column 200 is attached to the hood, the substantially airtight purge zone 80 is formed.

Figure 6:
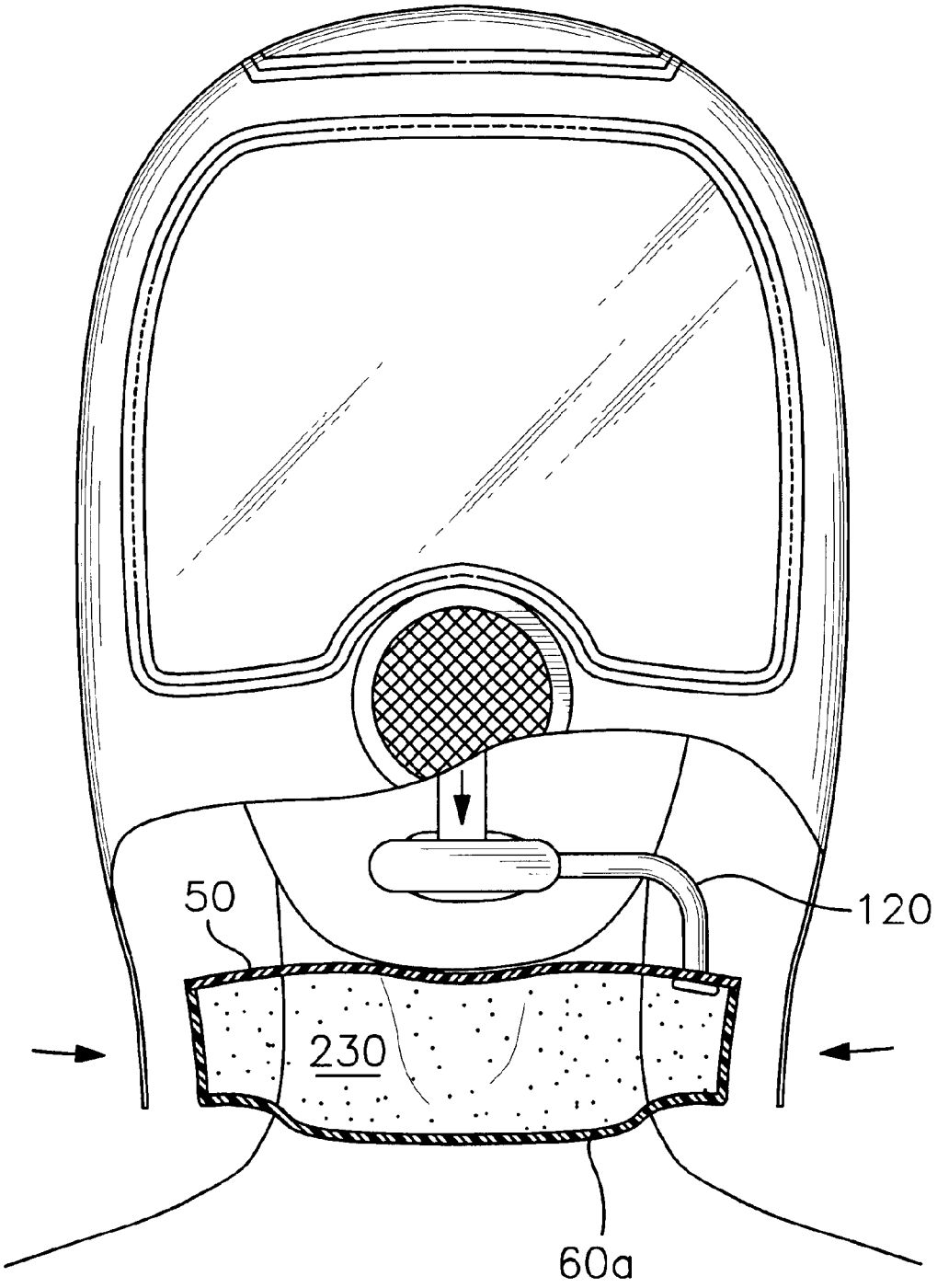
FIG. 6 is a partial sectional, partially exploded, elevation view of an alternative embodiment of the invention having vertically separated first and second substantially airtight seals provided by a modular seal column.

FIG. 6 shows still another embodiment of the invention utilizing the seal column. In this embodiment a modular purge zone 230 is prefabricated for integration into the air impermeable hood. The first substantially airtight seal 50 is pre-sealed to the first inside perimeter of the seal column and the second substantially airtight seal 60*a* is pre-sealed to the second inside perimeter of the seal column. The modular purge zone 230 is then air impermeably sealed to the hood aperture. Additional modular purge zones may be stacked vertically to provide multiple purge zones.

Figure 7:
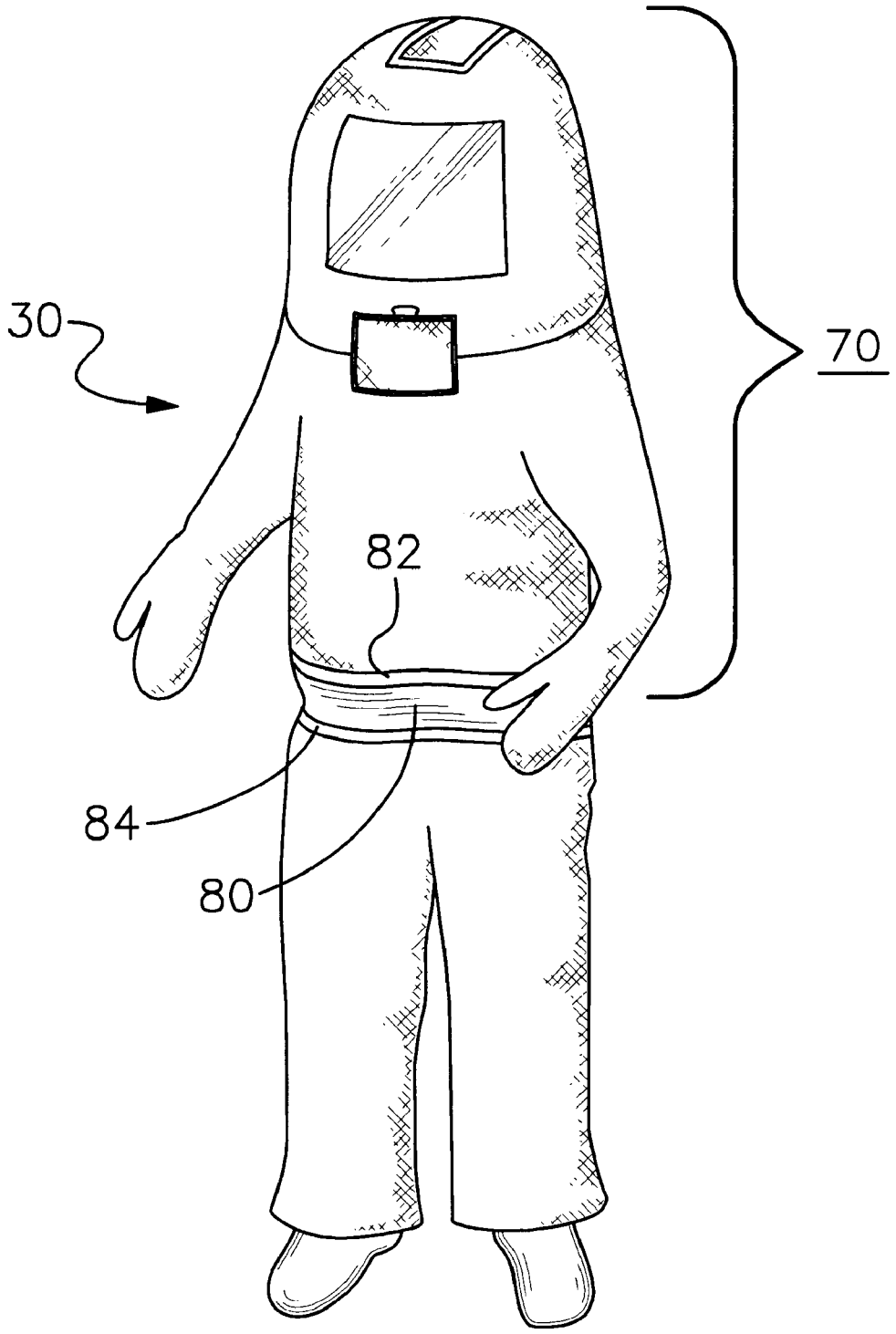
FIG. 7 is a perspective view depicting a torso-sealing embodiment of the invention.

FIG. 7 illustrates an alternative embodiment of the invention sealing at the torso. This embodiment is particularly appropriate for infants and young children with fragile necks. Purge zone 80 is created between a first airtight seal 82 and a second airtight seal 84. Protective zone 70 encloses the head and torso as well as the arms and hands of the wearer 30 as shown in FIG. 7.

Figure 8:
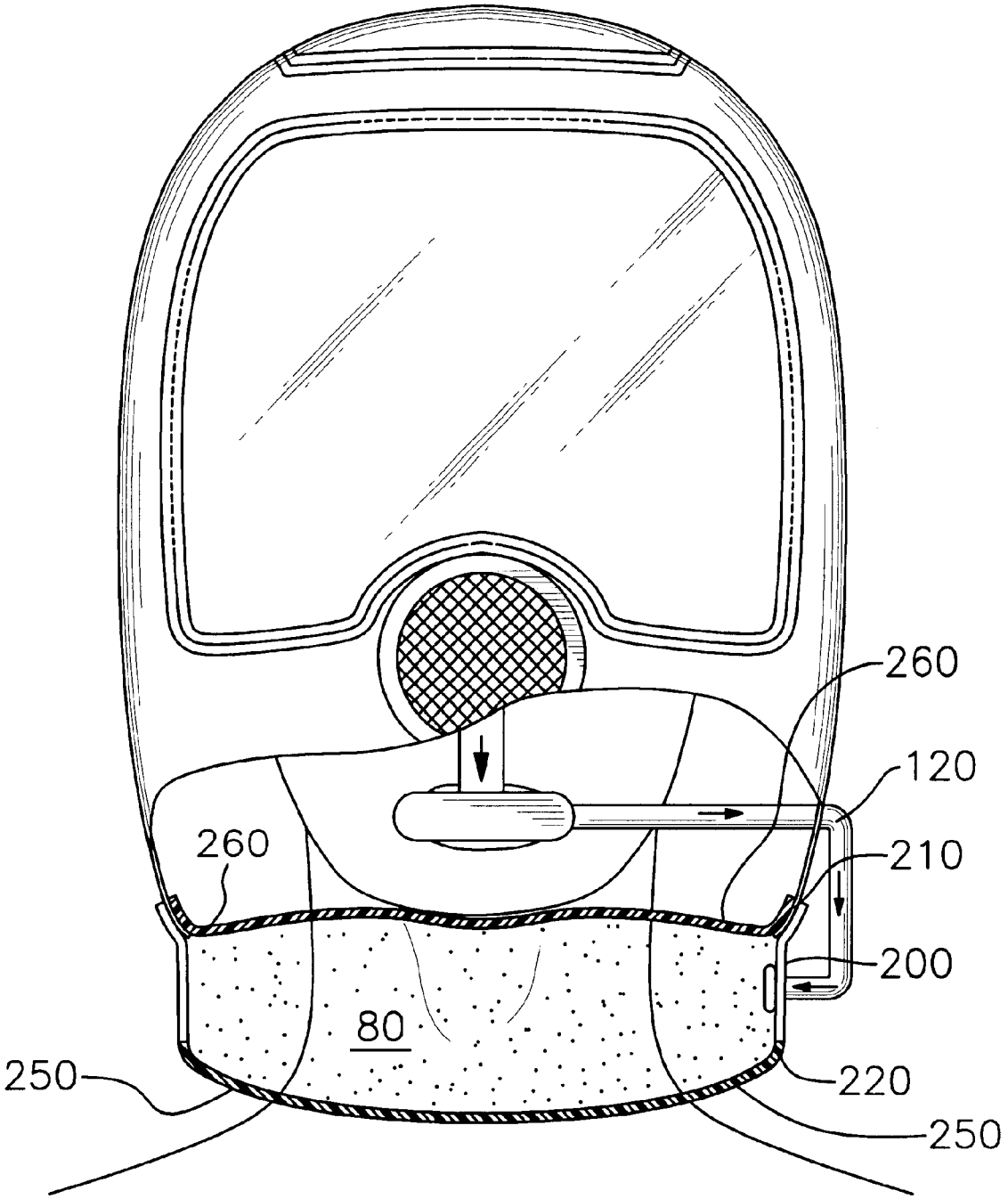
FIG. 8 is a partial sectional, partially exploded, elevation view of the purge zone ballooning in volume as a result of exhaled air being introduced into the purge zone.

In FIG. 8, exhaled air increases the air pressure and volume of the purge zone 80. When the purge zone 80, and more specifically, the first substantially airtight seal and the second substantially airtight seal are constructed of elastomeric material having a substantially low elasticity modulus, the total volume of the purge zone 80 increases. A ballooning effect is achieved by the first substantially airtight seal 260 and the second substantially airtight seal 250 elastically accommodating additional exhaled air. While the volume of the purge zone 80 increases, so does the plenum. Accordingly, during periods of intermitted respiration, the purge zone 80 volume slowly contracts whereby a continual pressurization is maintained.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween. Now that the invention has been described.

What is claimed is:

1. A multiple zone protective enclosure comprising:

an air-impermeable hood;

said air-impermeable hood adapted to receive a wearer's head;

said air-impermeable hood having a closed first end and an open second end;

an air-impermeable transparent viewing area integrated into said air-impermeable hood, said air-impermeable transparent viewing area adapted to permit outward vision by said wearer;

a first substantially airtight seal having a predetermined resistance to airflow, having an outer peripheral edge secured to said second end of said air-impermeable hood, and having an inner peripheral edge adapted to sealingly engage a wearer's neck;

a second substantially airtight seal having a predetermined resistance to airflow, having an outer peripheral edge secured to said second end of said air-impermeable hood and having an inner peripheral edge adapted to sealingly engage a wearer's neck;

said inner peripheral edge of said first substantially airtight seal adapted to sealingly engage said wearer's neck along a first annular line of contact and said inner peripheral edge of said second substantially airtight seal adapted to sealingly engage said wearer's neck along a second annular line of contact, said first and second annular lines of contact being disposed in vertically spaced apart relation to one another when said hood encloses the head of said wearer;

a protection zone adapted to enclose the head of said wearer, said protection zone being defined by said air-impermeable hood and said first substantially airtight seal, said protection zone adapted to surround said head of said wearer;

a purge zone defined between said first and second substantially airtight seals, said purge zone adapted to encircle said neck of said wearer;

a respiration interface having an inhalation pathway and an exhalation pathway, said inhalation pathway adapted to receive purified air and said exhalation pathway adapted to dispatch exhaled air;

an exhalation conduit disposed in fluid communicating relation between said exhalation pathway and said purge zone;

said first and second substantially airtight seals providing a substantially universal fit;

whereby when said first predetermined resistance to airflow of said first substantially airtight seal is greater than said second predetermined resistance to airflow of said second substantially airtight seal, exhaled air intermittently flows into said purge zone until a predetermined threshold pressure is reached, whereupon said exhaled air flows into ambient by overcoming the sealing power of said second substantially air tight seal;

whereby when said first predetermined resistance to airflow of said first substantially airtight seal is substantially equal to said second predetermined resistance to airflow of said second substantially airtight seal, exhaled air intermittently flows into said purge zone until a predetermined threshold pressure is reached, whereupon said exhaled air flows in substantially equal amounts into said protective zone and to ambient by substantially simultaneously overcoming said first and second predetermined resistances to airflow of said first and second substantially air tight seals; and whereby when said first predetermined resistance to airflow of said first substantially airtight seal is less than said second predetermined resistance to airflow of said second substantially airtight seal, exhaled air intermittently flows into said purge zone until a predetermined threshold pressure is reached, whereupon said exhaled air flows into said protection zone, thereby pressurizing said protection zone, until pressure is equalized on opposite sides of said first substantially airtight seal so that subsequent exhalations cause exhaled air to flow out of the purge zone into ambient.

2. The multiple zone protective enclosure of claim 1 wherein said purge zone is constructed of elastomeric material having a substantially low elasticity modulus whereby exhaled air flowing into said purge zone causes said purge zone to balloon in volume.

3. The multiple zone protective enclosure of claim 1 wherein said exhalation conduit is mated externally to said air-impermeable hood to discharge exhaled air directly into said purge zone.

4. The multiple zone protective enclosure of claim 1 wherein said exhalation conduit is mated internally within said air-impermeable hood to discharge exhaled air directly into said at least one purge zone.

5. The multiple zone protective enclosure of claim 1 wherein said first substantially airtight seals and said second substantially airtight seals are formed of elastomeric material.

6. The multiple zone protective cover of claim 1 further comprising an air-impermeable seal column that depends from said second end of said air-impermeable hood, said air-impermeable seal column having a first end and a second end, said first substantially airtight seal being engaged to said second end of said hood and said second substantially airtight seal being engaged to said second end of said seal column, thereby vertically spacing said first substantially airtight seal apart from said second substantially airtight seal.

7. The multiple zone protective enclosure of claim 6 wherein said first substantially airtight seal is pre-sealed to said first end of said seal column and said second substantially airtight seal is pre-sealed to said second end of said seal column thereby forming a modular purge zone for integration into said air-impermeable hood.

8. The multiple zone protection enclosure of claim 1, further comprising:

a third substantially airtight seal having an outer peripheral edge secured to said second end of said air-impermeable hood and having an inner peripheral edge adapted to sealingly engage said wearer's neck;

said inner peripheral edge of said third substantially airtight seal adapted to sealingly engage said wearer's neck along a third annular line of contact, said second annular line of contact being disposed between said first and second annular lines of contact when said hood encloses the head of said wearer.

9. The multiple zone protection enclosure of claim 8, further comprising:

creating a second purge zone by providing a third substantially airtight seal and securing an outer peripheral edge of said third substantially airtight seal to said second end of said air-impermeable hood and by adapting an inner peripheral edge of said second substantially airtight seal to sealingly engage a neck of said wearer along a third annular line of contact;

positioning said first, second, and third annular lines of contact in vertically spaced apart relation to one another when said hood encloses the head of said wearer so that said second purge zone is adjacent said first purge zone and so that said second substantially airtight seal separates said first purge zone from said second purge zone.

10. A multiple zone protective enclosure comprising:

an air-impermeable hood;

said air-impermeable hood adapted to receive a wearer's head;

said air-impermeable hood having a closed first end and an open second end;

an air-impermeable transparent viewing area integrated into said air-impermeable hood, said air-impermeable transparent viewing area adapted to permit outward vision by said wearer;

a first substantially airtight seal having a predetermined resistance to airflow, having an outer peripheral edge secured to said second end of said air-impermeable hood and having an inner peripheral edge adapted to sealingly engage a wearer's neck;

said inner peripheral edge of said first substantially airtight seal adapted to sealingly engage said wearer's neck along a first annular line of contact and said inner peripheral edge of said second substantially airtight seal adapted to sealingly engage said wearer's neck along a second annular line of contact, said first and second annular lines of contact being disposed in vertically spaced apart relation to one another when said hood encloses the head of said wearer;

a protection zone adapted to enclose the head of said wearer;

said protection zone being defined by said air-impermeable hood and said first substantially airtight seal;

an air-impermeable seal column depending from said second end of said air-impermeable hood, said air-impermeable seal column having a first end a second end;

an outer peripheral edge of said second substantially airtight seal being secured to said second end of said seal column and having an inner peripheral edge adapted to sealingly engage a wearer's neck;

a purge zone being defined between said first and second substantially airtight seals;

a respiration interface having an inhalation pathway and an exhalation pathway, said inhalation pathway adapted to receive purified air through a particle filtration filter and said exhalation pathway adapted to dispatch exhaled air;

an exhalation conduit disposed in fluid communicating relation between said exhalation pathway and said purge zone;

said first and second substantially airtight seals providing a substantially universal fit;

whereby when said first predetermined resistance to airflow of said first substantially airtight seal is greater than said second predetermined resistance to airflow of said second substantially airtight seal, exhaled air intermittently flows into said purge zone until a predetermined threshold pressure is reached, whereupon said exhaled air flows into ambient by overcoming the sealing power of said second substantially air tight seal;

whereby when said first predetermined resistance to airflow of said first substantially airtight seal is substantially equal to said second predetermined resistance to airflow of said second substantially airtight seal, exhaled air intermittently flows into said purge zone until a predetermined threshold pressure is reached, whereupon said exhaled air flows in substantially equal amounts into said protective zone and to ambient by substantially simultaneously overcoming said first and second predetermined resistances to airflow of said first and second substantially air tight seals; and whereby when said first predetermined resistance to airflow of said first substantially airtight seal is less than said second predetermined resistance to airflow of said second substantially airtight seal, exhaled air intermittently flows into said purge zone until a predetermined threshold pressure is reached, whereupon said exhaled air flows into said protection zone, thereby pressurizing said protection zone, until pressure is equalized on opposite sides of said first substantially airtight seal so that subsequent exhalations cause exhaled air to flow out of the purge zone into ambient.

11. A multiple zone protective enclosure comprising:

an air-impermeable hood;

said air-impermeable hood adapted to receive a wearer's head;

said air-impermeable hood having a closed first end and an open second end;

an air-impermeable transparent viewing area integrated into said air-impermeable hood, said air-impermeable transparent viewing area adapted to permit outward vision by said wearer;

a first substantially airtight seal having a predetermined resistance to airflow, having an outer peripheral edge secured to said second end of said air-impermeable hood and having an inner peripheral edge adapted to sealingly engage a wearer's neck;

a second substantially airtight seal having an outer peripheral edge secured to said second end of said air-impermeable hood and having an inner peripheral edge adapted to sealingly engage said wearer's neck;

said inner peripheral edge of said first substantially airtight seal adapted to sealingly engage said wearer's neck along a first annular line of contact and said inner peripheral edge of said second substantially airtight seal adapted to sealingly engage said wearer's neck along a second annular line of contact, said first and second annular lines of contact being disposed in vertically spaced apart relation to one another when said hood encloses the head of said wearer;

a protection zone adapted to enclose the head of said wearer;

said protection zone being defined by said air-impermeable hood and said first substantially airtight seal;

an air-impermeable seal column depending from said second end of said air-impermeable hood, said air-impermeable seal column having a first end and a second end, and said first substantially airtight seal being pre-sealed to said first end of said seal column, said second substantially airtight seal being pre-sealed to said second end of said seal column;

an outer peripheral edge of said second substantially airtight seal being secured to said second end of said seal column and having an inner peripheral edge adapted to sealingly engage said wearer's neck;

a modular purge zone being defined between said first and second substantially airtight seals;

a respiration interface having an inhalation pathway and an exhalation pathway, said inhalation pathway adapted to receive purified air through a particle filtration filter and said exhalation pathway adapted to dispatch exhaled air;

an exhalation conduit disposed in fluid communicating relation between said exhalation pathway and said purge zone;

said first and second substantially airtight seals providing a substantially universal fit;

whereby when said first predetermined resistance to airflow of said first substantially airtight seal is greater than said second predetermined resistance to airflow of said second substantially airtight seal, exhaled air intermittently flows into said purge zone until a predetermined threshold pressure is reached, whereupon said exhaled air flows into ambient by overcoming the sealing power of said second substantially air tight seal;

whereby when said first predetermined resistance to airflow of said first substantially airtight seal is substantially equal to said second predetermined resistance to airflow of said second substantially airtight seal, exhaled air intermittently flows into said purge zone until a predetermined threshold pressure is reached, whereupon said exhaled air flows in substantially equal amounts into said protective zone and to ambient by substantially simultaneously overcoming said first and second predetermined resistances to airflow of said first and second substantially air tight seals; and whereby when said first predetermined resistance to airflow of said first substantially airtight seal is less than said second predetermined resistance to airflow of said second substantially airtight seal, exhaled air intermittently flows into said purge zone until a predetermined threshold pressure is reached, whereupon said exhaled air flows into said protection zone, thereby pressurizing said protection zone, until pressure is equalized on opposite sides of said first substantially airtight seal so that subsequent exhalations cause exhaled air to flow out of the purge zone into ambient.

12. A method of using exhaled air to inflate a protective hood comprising the steps of:

enclosing the head of a wearer with an air-impermeable hood having a closed first end and an open second end;

integrating an air-impermeable transparent viewing area into said air-impermeable hood, said air-impermeable transparent viewing area adapted to permit outward vision by said wearer;

creating a protection zone for the eyes, nose, and mouth of said wearer by providing a first substantially airtight seal and securing an outer peripheral edge of said first substantially airtight seal to said second end of said air-impermeable hood and by adapting an inner peripheral edge of said first substantially airtight seal to sealingly engage a neck of said wearer along a first annular line of contact;

creating a first purge zone by providing a second substantially airtight seal and securing an outer peripheral edge of said second substantially airtight seal to said second end of said air-impermeable hood and by adapting an inner peripheral edge of said second substantially airtight seal to sealingly engage a neck of said wearer along a second annular line of contact;

positioning said first and second annular lines of contact in vertically spaced apart relation to one another when said hood encloses the head of said wearer so that said first purge zone is adjacent said protection zone and so that said first substantially airtight seal separates said protection zone from said first purge zone;

engaging a respiration interface to the respiratory system of said wearer, said respiration interface having an inhalation pathway adapted to receive purified air and an exhalation pathway adapted to dispatch exhaled air;

connecting an exhalation conduit having a one-way check valve means adapted to restrict the flow of exhaled air only from said exhalation pathway to said first purge zone; and whereby exhaled air flows through said exhalation conduit into said first purge zone, increasing the air pressure within said first purge zone until air, following the path of least resistance, is forced through said first substantially airtight seal into said protection zone;

whereby when said first predetermined resistance to airflow of said first substantially airtight seal is greater than said second predetermined resistance to airflow of said second substantially airtight seal, exhaled air intermittently flows into said first purge zone until a predetermined threshold pressure is reached, whereupon said exhaled air flows into ambient by overcoming the sealing power of said second substantially air tight seal;

whereby when said first predetermined resistance to airflow of said first substantially airtight seal is substantially equal to said second predetermined resistance to airflow of said second substantially airtight seal, exhaled air intermittently flows into said first purge zone until a predetermined threshold pressure is reached, whereupon said exhaled air flows in substantially equal amounts into said protective zone and to ambient by substantially simultaneously overcoming said first and second predetermined resistances to airflow of said first and second substantially air tight seals; and whereby when said first predetermined resistance to airflow of said first substantially airtight seal is less than said second predetermined resistance to airflow of said second substantially airtight seal, exhaled air intermittently flows into said first purge zone until a predetermined threshold pressure is reached, whereupon said exhaled air flows into said protection zone, thereby pressurizing said protection zone, until pressure is equalized on opposite sides of said first substantially airtight seal so that subsequent exhalations cause exhaled air to of the first purge zone into ambient.

13. The method of claim 12 further comprising the step of mating said exhalation conduit between said protection zone and said purge zone external to said air-impermeable hood.

14. The method of claim 12 further comprising the step of mating said exhalation conduit between said protection zone and said purge zone within said air-impermeable hood.

15. The method of claim 12 further comprising the step of constructing said first substantially airtight seal and aid second substantially airtight seals of elastomeric material.

16. The method of claim 12 further comprising the step of disposing an air-impermeable seal column in depending relation to said air-impermeable hood, said air-impermeable hood having a first end and a second end, said first substantially airtight seal being engaged to said second end of said hood and said second substantially airtight seal being engaged to a second end of said seal column, thereby vertically spacing apart said first substantially airtight seal and said second substantially airtight seal.

17. The method of claim 16 further comprising the step of pre-sealing said first substantially airtight seal to s first end of said seal column and pre-sealing said second substantially airtight seal to said second end of said seal column thereby forming a modular purge zone for integration into said air impermeable hood.

18. A multiple zone protective enclosure comprising:

an air-impermeable hood;

said air-impermeable hood adapted to receive a wearer's head and torso;

said air-impermeable hood having a closed first end and an open second end;

an air-impermeable transparent viewing area integrated into said air-impermeable hood, said air-impermeable transparent viewing area adapted to permit outward vision by said wearer;

a first substantially airtight seal having an outer peripheral edge secured to said second end of said air-impermeable hood and having an inner peripheral edge adapted to sealingly engage a wearer's torso;

a second substantially airtight seal having an outer peripheral edge secured to said second end of said air-impermeable hood and having an inner peripheral edge adapted to sealingly engage a wearer's torso;

said inner peripheral edge of said first substantially airtight seal adapted to sealingly engage said wearer's torso along a first annular line of contact and said inner peripheral edge of said second substantially airtight seal adapted to sealingly engage said wearer's torso along a second annular line of contact, said first and second annular lines of contact being disposed in vertically spaced apart relation to one another when said hood encloses the head and torso of said wearer;

a protection zone adapted to enclose the head and torso of said wearer, said protection zone being defined by said air-impermeable hood and said first substantially airtight seal, said protection zone adapted to surround said head and torso of said wearer;

a purge zone defined between said first and second substantially airtight seals, said purge zone adapted to encircle said torso of said wearer;

a respiration interface having an inhalation pathway and an exhalation pathway, said inhalation pathway adapted to receive purified air and said exhalation pathway adapted to dispatch exhaled air;

an exhalation conduit disposed in fluid communicating relation between said exhalation pathway and said purge zone;

said first and second substantially airtight seals providing a substantially universal fit;

whereby when said first predetermined resistance to airflow of said first substantially airtight seal is greater than said second predetermined resistance to airflow of said second substantially airtight seal, exhaled air intermittently flows into said purge zone until a predetermined threshold pressure is reached, whereupon said exhaled air flows into ambient by overcoming the sealing power of said second substantially air tight seal;

whereby when said first predetermined resistance to airflow of said first substantially airtight seal is substantially equal to said second predetermined resistance to airflow of said second substantially airtight seal, exhaled air intermittently flows into said purge zone until a predetermined threshold pressure is reached, whereupon said exhaled air flows in substantially equal amounts into said protective zone and to ambient by substantially simultaneously overcoming said first and second predetermined resistances to airflow of said first and second substantially air tight seals; and whereby when said first predetermined resistance to airflow of said first substantially airtight seal is less than said second predetermined resistance to airflow of said second substantially airtight seal, exhaled air intermittently flows into said purge zone until a predetermined threshold pressure is reached, whereupon said exhaled air flows into said protection zone, thereby pressurizing said protection zone, until pressure is equalized on opposite sides of said first substantially airtight seal so that subsequent exhalations cause exhaled air to flow out of the purge zone into ambient.

* * * * *